US012595539B2

(12) United States Patent
Kim et al.

(10) Patent No.: US 12,595,539 B2
(45) Date of Patent: Apr. 7, 2026

(54) QT HEAT TREATED HIGH CARBON HOT ROLLED STEEL SHEET, HIGH CARBON COLD ROLLED STEEL SHEET, QT HEAT TREATED HIGH CARBON COLD ROLLED STEEL SHEET, AND MANUFACTURING METHODS THEREOF

(71) Applicant: POSCO Co., Ltd, Pohang-si (KR)

(72) Inventors: Sun-Mi Kim, Pohang-si (KR); Jae-Hun Choi, Pohang-si (KR); Hak-Jun Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 372 days.

(21) Appl. No.: 18/268,511

(22) PCT Filed: Dec. 10, 2021

(86) PCT No.: PCT/KR2021/018729
§ 371 (c)(1),
(2) Date: Jun. 20, 2023

(87) PCT Pub. No.: WO2022/139278
PCT Pub. Date: Jun. 30, 2022

(65) Prior Publication Data

US 2024/0076766 A1 Mar. 7, 2024

(30) Foreign Application Priority Data

Dec. 21, 2020 (KR) ..... 10-2020-0179284

(51) Int. Cl.

| | |
|---|---|
| ***C22C 38/26*** | (2006.01) |
| ***C21D 1/18*** | (2006.01) |
| ***C21D 1/32*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/22*** | (2006.01) |
| ***C22C 38/24*** | (2006.01) |

(52) U.S. Cl.
CPC ..... *C22C 38/26* (2013.01); *C21D 1/18* (2013.01); *C21D 1/32* (2013.01); *C21D 6/002* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 9/46* (2013.01); *C22C 38/002* (2013.01); *C22C 38/02* (2013.01); *C22C 38/04* (2013.01); *C22C 38/22* (2013.01); *C22C 38/24* (2013.01); *C21D 2211/003* (2013.01); *C21D 2211/005* (2013.01); *C21D 2211/008* (2013.01); *C21D 2211/009* (2013.01)

(58) Field of Classification Search
CPC ..... C22C 38/26; C22C 38/002; C22C 38/02; C22C 38/04; C22C 38/22; C22C 38/24; C22C 38/06; C21D 1/18; C21D 1/32; C21D 6/002; C21D 6/005; C21D 6/008; C21D 8/0205; C21D 8/0226; C21D 8/0236; C21D 8/0263; C21D 9/46; C21D 2211/003; C21D 2211/005; C21D 2211/008; C21D 2211/009; C21D 2211/002; C21D 1/25; C21D 8/0273
See application file for complete search history.

(56) References Cited

U.S. PATENT DOCUMENTS

| | | | | |
|---|---|---|---|---|
| 4,168,159 | A | 9/1979 | Schlatter et al. | |
| 6,641,681 | B1 | 11/2003 | Sandberg et al. | |
| 2013/0295402 | A1 | 11/2013 | Oh et al. | |
| 2017/0067132 | A1* | 3/2017 | Takeda | C22C 38/02 |
| 2017/0121787 | A1 | 5/2017 | Miyamoto et al. | |
| 2017/0204486 | A1* | 7/2017 | Shouji | C22C 37/06 |

FOREIGN PATENT DOCUMENTS

| | | | |
|---|---|---|---|
| CN | 103392022 | A | 11/2013 |
| CN | 105637108 | A | 6/2016 |
| CN | 106062231 | A | 10/2016 |
| CN | 106133170 | A | 11/2016 |
| EP | 3216889 | B1 | 12/2018 |
| JP | H01-198447 | A | 8/1989 |
| JP | 3-53021 | A | 3/1991 |
| JP | 2001-049393 | A | 2/2001 |

(Continued)

OTHER PUBLICATIONS

Office Action issued Apr. 3, 2025 in Chinese Patent Application No. 202180087091.5.

(Continued)

*Primary Examiner* — Ricardo D Morales

(74) *Attorney, Agent, or Firm* — Sughrue Mion, PLLC

(57) ABSTRACT

Provided are a QT heat treated high carbon hot rolled steel sheet, a high carbon cold rolled steel sheet, a QT heat treated high carbon cold rolled steel sheet, and manufacturing methods thereof, wherein the QT heat treated high carbon hot rolled steel sheet comprises, in weight %, C: 1.0-1.4%, Si: 0.1-0.4%, Mn: 0.1-0.8%, Cr: 0.3-11%, W: 0.05-2.5%, P: 0.03% or less, S: 0.03% or less, Al: 0.02% or less, and the balance being Fe and other inevitable impurities, the average size of carbides being 0.1-20 μm.

6 Claims, No Drawings

(56) References Cited

FOREIGN PATENT DOCUMENTS

| | | | |
|---|---|---|---|
| JP | 2001-200341 | A | 7/2001 |
| JP | 2007-302984 | A | 11/2007 |
| JP | 2009-001910 | A | 1/2009 |
| JP | 2009-161809 | A | 7/2009 |
| JP | 2010-138453 | A | 6/2010 |
| JP | 2014-508854 | A | 4/2014 |
| JP | 2017-36492 | A | 2/2017 |
| KR | 10-2002-0038767 | A | 5/2002 |
| KR | 10-0722389 | A | 5/2007 |
| KR | 10-2012-0073407 | A | 7/2012 |
| KR | 10-2014-0118314 | A | 10/2014 |
| KR | 10-2016-0119220 | A | 10/2016 |
| KR | 10-2017-0075783 | A | 7/2017 |
| WO | 2015133644 | A1 | 9/2015 |
| WO | 2020246937 | A1 | 12/2020 |

OTHER PUBLICATIONS

International Search Report for PCT/KR2021/018729 dated Apr. 13, 2022.

* cited by examiner

QT HEAT TREATED HIGH CARBON HOT ROLLED STEEL SHEET, HIGH CARBON COLD ROLLED STEEL SHEET, QT HEAT TREATED HIGH CARBON COLD ROLLED STEEL SHEET, AND MANUFACTURING METHODS THEREOF

CROSS REFERENCE TO RELATED APPLICATIONS

This application is a National Stage of International Application No. PCT/KR2021/018729 filed Dec. 10, 2021, claiming priority based on Korean Patent Application No. 10-2020-0179284 filed Dec. 21, 2020, the entire disclosures of which are incorporated herein by reference.

TECHNICAL FIELD

The present disclosure relates to a QT heat treated high carbon hot rolled steel sheet, a high carbon cold rolled steel sheet, a QT heat treated high carbon cold rolled steel sheet, and a manufacturing method thereof.

BACKGROUND ART

High carbon steel refers to a steel material containing 0.3% or more of carbon or about 0.15% of carbon and other alloy elements. In general, since hardness and strength of steel materials increase as a carbon content increases, carbon is used as the most economical and effective element for controlling physical properties of the steel materials. In the JIS standard, steel types are classified according to the carbon content, and among the steel types currently produced in a converter, a steel type having the highest carbon content is SK120, and the carbon content of the SK120 is 1.15 to 1.25%.

The SK120 may obtain higher hardness by phase transforming a microstructure into martensite through quenching heat treatment at a high temperature in an austenite single phase region. However, since the martensite has strong brittleness, tempering is performed after performing the reheating in the austenite region to secure toughness. Typically, this series of heat treatment processes is referred to as quenching-tempering (QT).

However, the SK120 has the advantage of excellent hardness and toughness after QT heat treatment as it contains 1.15 to 1.25% of C, but has the disadvantage of low wear resistance because it is formed of a single phase of tempered martensite.

In order to compensate for this disadvantage, when the QT heat treatment is performed using the SK120 subjected to spheroidization annealing heat treatment, a method was developed to allow some cementite to remain by adjusting the reheating temperature and time. However, the cementite has a hardness of 1300 Hv, and it is difficult to expect excellent wear resistance because there is no significant difference in hardness from a base material, tempered martensite. In addition, since the cementite is dissolved in the reheating temperature range during the QT heat treatment process, there is a disadvantage in that an advanced heat treatment technology is required.

DISCLOSURE

Technical Problem

The present disclosure provides a QT heat treated high carbon hot rolled steel sheet, a high carbon cold rolled steel sheet, a QT heat treated high carbon cold rolled steel sheet, and a manufacturing method thereof.

Technical Solution

In an aspect in the present disclosure, a QT heat treated high carbon hot rolled steel sheet may include: in weight %, C: 1.0 to 1.4%, Si: 0.1 to 0.4%, Mn: 0.1 to 0.8%, Cr: 0.3 to 11%, W: 0.05 to 2.5%, P: 0.03% or less, S: 0.03% or less, Al: 0.02% or less, and a balance of Fe and other inevitable impurities, in which a microstructure may contain, in area %, carbide: 0.1 to 20% and the balance being tempered martensite, and an average size of the carbide may be 0.1 to 20 μm.

In another aspect in the present disclosure, a high carbon cold rolled steel sheet may include: in weight %, C: 1.0 to 1.4%, Si: 0.1 to 0.4%, Mn: 0.1 to 0.8%, Cr: 0.3 to 11%, W: 0.05 to 2.5%, P: 0.03% or less, S: 0.03% or less, Al: 0.02% or less, and a balance of Fe and other inevitable impurities, in which a microstructure may include, in area %, ferrite: 20 to 99.9%, cementite: 10% or less, pearlite: 50% or less, and carbide: 0.1 to 20%, and an average size of the carbide may be 0.1 to 20 μm.

In another aspect in the present disclosure, a QT heat treated high carbon cold rolled steel sheet may include: in weight %, C: 1.0 to 1.4%, Si: 0.1 to 0.4%, Mn: 0.1 to 0.8%, Cr: 0.3 to 11%, W: 0.05 to 2.5%, P: 0.03% or less, S: 0.03% or less, Al: 0.02% or less, and a balance of Fe and other inevitable impurities, in which a microstructure may contain, in area %, carbide: 0.1 to 20% and the balance being tempered martensite, and an average size of the carbide may be 0.1 to 20 μm.

In another aspect in the present disclosure, a method for manufacturing a QT heat treated high carbon hot rolled steel sheet may include: preparing a hot-rolled steel sheet containing, in weight %, C: 1.0 to 1.4%, Si: 0.1 to 0.4%, Mn: 0.1 to 0.8%, Cr: 0.3 to 11%, W: 0.05 to 2.5%, P: 0.03% or less, S: 0.03% or less, Al: 0.02% or less, and a balance of Fe and other inevitable impurities; reheating the prepared hot-rolled steel sheet at 740 to 1100° C.; cooling the reheated hot-rolled steel sheet at a cooling rate of 10° C./s or more; and tempering the cooled hot-rolled steel sheet at 150 to 600° C.

In another aspect in the present disclosure, a method for manufacturing a high carbon cold rolled steel sheet may include: preparing a hot-rolled steel sheet containing, in weight %, C: 1.0 to 1.4%, Si: 0.1 to 0.4%, Mn: 0.1 to 0.8%, Cr: 0.3 to 11%, W: 0.05 to 2.5%, P: 0.03% or less, S: 0.03% or less, Al: 0.02% or less, and a balance of Fe and other inevitable impurities; and obtaining a cold-rolled steel sheet by cold-rolling the prepared hot-rolled steel sheet.

In another aspect in the present disclosure, a method for manufacturing a QT heat treated high carbon cold rolled steel sheet may include: preparing a hot-rolled steel sheet containing, in weight %, C: 1.0 to 1.4%, Si: 0.1 to 0.4%, Mn: 0.1 to 0.8%, Cr: 0.3 to 11%, W: 0.05 to 2.5%, P: 0.03% or less, S: 0.03% or less, Al: 0.02% or less, and a balance of Fe and other inevitable impurities; obtaining a cold-rolled steel sheet by cold-rolling the prepared hot-rolled steel sheet; reheating the cold-rolled steel sheet at 740 to 1100° C.; cooling the reheated cold-rolled steel sheet at a cooling rate of 10° C./s or more; and tempering the cooled cold-rolled steel sheet at 150 to 600° C.

Advantageous Effects

As set forth above, according to the present disclosure, it is possible to provide a QT heat treated high carbon hot rolled steel sheet, a high carbon cold rolled steel sheet, a QT heat treated high carbon cold rolled steel sheet, and a manufacturing method thereof.

BEST MODE

Hereinafter, a high carbon steel of the present disclosure will be described. First, an alloy composition of the high carbon steel of the present disclosure will be described. The content of the alloy composition described below refers to weight % unless otherwise specified.

C: 1.0 to 1.4%

C is an alloy element that has the greatest effect on improving the strength and hardness of steel. C is an element that stably forms austenite, and has a solid solution strengthening effect when present in a solid solution state because of its small atomic size. Meanwhile, since C has a low solid solution limit in a ferrite structure, the C meets with an alloy element forming carbides to form precipitates, or combines with Fe to form cementite (Fe3C), thereby exhibiting a strengthening effect. Since C has a fast diffusion rate, redistribution occurs quickly even if it is kept at high temperature for a short time. Therefore, the C has the greatest influence on increasing a hardness of martensite, and at the same time increases wear resistance of steel. When the C is added in an amount of less than 1.0%, the above-described effect of improving strength and wear resistance is not sufficient. On the other hand, when the C content exceeds 1.4%, pro-eutectoid cementite is formed at an austenite grain boundary, and thus toughness may decrease. Therefore, the C content preferably ranges from 1.0 to 1.4%. A lower limit of the C content is more preferably 1.05%. An upper limit of the C content is more preferably 1.35%, and even more preferably 1.3%.

Si: 0.1 to 0.4%

Si is an element that stably forms ferrite and improves strength by being dissolved in ferrite. When the Si content is less than 0.1%, the solid solution strengthening effect is not sufficient, and when the Si content exceeds 0.4%, hot processability and toughness deteriorate. Therefore, the Si content preferably ranges from 0.1 to 0.4%. The upper limit of the Si content is more preferably 0.35%.

Mn 0.1 to 0.8%

Mn has the effect of improving cleanliness of steel as a deoxidation and desulfurizing agent. In addition, the Mn is added to secure hardenability considering a cooling level. When the Mn content is less than 0.1%, the effect is insufficient, and when the Mn content exceeds 0.8%, a segregation layer is formed in a central portion of the thickness to lower processability. Therefore, the Mn content preferably ranges from 0.1 to 0.8%. An upper limit of the Mn content is more preferably 0.7%, and even more preferably 0.6%.

Cr: 0.3 to 11%

Cr is a ferrite stabilizing element, and is an element that is dissolved in a base structure to secure hardenability. In addition, since the Cr combines with C to form hard $Cr_7C_3$ carbide, there is an effect of improving hardness and wear resistance. When the Cr content is less than 0.3%, the effect is insufficient, and when the Cr content exceeds 11%, the toughness may deteriorate due to the excessive hardenability and formation of coarse $Cr_7C_3$ carbides. Therefore, the Cr content preferably ranges from 0.3 to 11%. An upper limit of the Cr content is more preferably 10.5%.

W: 0.05 to 2.5%

W improves wear resistance by combining with C to form hard carbide of 2300 to 2800 Hv. For the above effect, it is preferable to add 0.05% or more of W. However, when the W exceeds 2.5%, there is a risk of causing brittleness due to excessive hardenability. Therefore, the W content preferably ranges from 0.05 to 2.5%. An upper limit of the W content is more preferably 2.45% or less, and even more preferably 2.35% or less.

P: 0.03% or Less

P is an impurity that may not be filtered out during a steelmaking process, and cleanliness and processability are improved as it is contained as little as possible. However, in the present disclosure, an upper limit of P is managed at 0.03% in consideration of economic feasibility.

S: 0.03% or Less

S is an impurity that may not be filtered out during a steelmaking process, and cleanliness and processability are improved as it is contained as little as possible. However, in the present disclosure, an upper limit of S is managed at 0.03% in consideration of economic feasibility.

Al: 0.02% or Less

Al is an element commonly used as a deoxidizer in a steelmaking process and is added to ensure cleanliness. However, in the present disclosure, a content of Al is managed to 0.02% or less in consideration of the effect and economic feasibility.

In addition to the steel composition described above, the remainder may include Fe and inevitable impurities. The inevitable impurities may be unintentionally mixed during the normal steel manufacturing process, and may not be completely excluded, and technicians in the normal steel manufacturing field may easily understand their meaning. Further, the present disclosure does not entirely exclude the addition of other compositions than the steel composition described above.

Meanwhile, according to the present disclosure, in addition to the above-described alloy composition, one or more selected from the group consisting of V: 0.8% or less (excluding 0%), Mo: 2.5% or less (excluding 0%), and Nb: 1.5% or less (excluding 0%) may be further contained.

V: 0.8% or Less (Excluding 0%)

V combines with C to form hard carbide of about 2300 Hv, to thereby improve wear resistance. However, when V exceeds 0.8%, brittleness may occur due to coarse V-containing carbides. Therefore, the V content is preferably in the range of 0.8% or less. A lower limit of the V content is more preferably 0.01%, and even more preferably 0.05%. An upper limit of the V content is more preferably 0.7%.

Mo: 2.5% or Less (Excluding 0%)

Mo alone combines with C or Mo combines with C together with elements such as V and Nb to form hard carbide to improve wear resistance. Also, like Cr, there is an effect of improving hardenability. However, when the Mo exceeds 2.5%, there is a risk of causing brittleness due to excessive hardenability. Therefore, the Mo content is preferably 2.5% or less. A lower limit of the Mo content is more preferably 0.1%, and even more preferably 0.2%. An upper limit of the Mo content is more preferably 2.4%.

Nb: 1.5% or Less (Excluding 0%)

Nb combines with C to form hard carbide to improve wear resistance. However, since a precipitation temperature of Nb is as high as about 1300° C., when a large amount is added, coarse carbides may be formed and toughness may be reduced. Therefore, the Nb content is preferably added in an amount of 1.5% or less. Therefore, the Nb content is preferably 1.5% or less. A lower limit of the Nb content is more preferably 0.05%, and even more preferably 0.1%. The upper limit of the Nb content is more preferably 1.2%.

Hereinafter, the QT heat treated high carbon hot rolled steel sheet of the present disclosure will be described.

The microstructure of the QT heat treated high carbon hot rolled steel sheet of the present disclosure preferably includes carbide: 0.1 to 20%, and the balance being tempered martensite in area %. In the present disclosure, by including tempered martensite as a base structure, it is possible to secure excellent wear resistance as well as resistance to impact. In addition, the present disclosure increases wear resistance by securing an appropriate fraction of carbides. When the fraction of the carbide is less than 0.1%, there is a disadvantage in that it is difficult to expect wear resistance by hard carbide, and when the fraction exceeds 20%, there is a disadvantage in that the material is easily destroyed due to brittleness. A lower limit of the fraction of the carbide is more preferably 0.2%, and even more preferably 0.5%. An upper limit of the fraction of the carbide is more preferably 18%, and even more preferably 16%. Meanwhile, in the present disclosure, the type of the carbide is not particularly limited, and for example, the carbide may be a single or composite carbide containing one or more of W, V, Mo, and Nb. Meanwhile, the microstructure of the QT heat treated high carbon hot rolled steel sheet of the present disclosure may inevitably include less than 10% of one or more of ferrite, pearlite, bainite, and retained austenite in a total amount due to the manufacturing process. When the total amount of one or more of the ferrite, pearlite, bainite, and retained austenite exceeds 10%, the hardness may decrease. The total amount of one or more of the ferrite, pearlite, bainite and retained austenite is more preferably 7% or less, and even more preferably 5%.

The carbide may have an average size of 0.1 to 20 μm. When the size of the carbide is less than 0.1 μm, the hardness improvement effect is insignificant, and when the size exceeds 20 μm, the brittleness of the steel material may be caused. A lower limit of an average size of the carbide is more preferably 0.3 μm, and even more preferably 0.5 μm. An upper limit of the average size of the carbide is more preferably 17 μm, and even more preferably 15 μm.

The QT heat treated high carbon hot rolled steel sheet according to one embodiment of the present disclosure provided as above may have a hardness of 350 Hv or more. In addition, when the wear resistance test was performed according to the ASTM G99 method, the QT heat treated high carbon hot rolled steel sheet may have a wear reduction of 35 mg or less when the reheating temperature before QT was 800° C., a wear reduction of 27 mg or less when the reheating temperature before QT was 850° C., and a wear reduction of 25 mg or less when the reheating temperature before QT is 900° C. As a result, it is possible to simultaneously secure excellent hardness and wear resistance.

Hereinafter, the high carbon cold rolled steel sheet of the present disclosure will be described.

The microstructure of the high carbon cold rolled steel sheet of the present disclosure may include, in area %, ferrite: 20 to 99.9%, cementite: 10% or less, pearlite: 50% or less, and carbide: 0.1 to 20%. When the ferrite is less than 20%, low hardness properties are not secured, so there is a disadvantage in that processability such as cold rolling deteriorates, and when the ferrite exceeds 99.9%, cementite or hard carbide is not secured, so the wear resistance is lowered after QT heat treatment. A lower limit of the fraction of the ferrite is more preferably 30%, and even more preferably 40%. An upper limit of the fraction of the ferrite is more preferably 99.8%, and even more preferably 99.5%. When the cementite exceeds 20%, there is a disadvantage in that processing is difficult by causing the brittleness of the material. A lower limit of the fraction of the cementite is more preferably 0.1%, and even more preferably 0.3%. An upper limit of the fraction of the cementite is more preferably 8%, and even more preferably 7%. When the pearlite content exceeds 50%, low hardness properties are not secured, resulting in poor processability such as cold rolling. A lower limit of the fraction of the pearlite is more preferably 1%, and even more preferably 5%. An upper limit of the fraction of the pearlite is more preferably 40%, and even more preferably 30%. When the fraction of the carbide is less than 0.1%, there is a disadvantage in that it is difficult to expect wear resistance by hard carbide, and when the fraction exceeds 20%, there is a disadvantage in that the material is easily destroyed due to brittleness. A lower limit of the fraction of the carbide is more preferably 0.2%, and even more preferably 0.5%. An upper limit of the fraction of the carbide is more preferably 18%, and even more preferably 16%.

The carbide may have an average size of 0.1 to 20 μm. When the size of the carbide is less than 0.1 μm, the hardness improvement effect is insignificant, and when the size exceeds 20 μm, the brittleness of the steel material may be caused. A lower limit of an average size of the carbide is more preferably 0.3 μm, and even more preferably 0.5 μm. An upper limit of the average size of the carbide is more preferably 17 μm, and even more preferably 15 μm.

The QT heat treated high carbon cold rolled steel sheet according to one embodiment of the present disclosure provided as above may have a hardness of 350 Hv or less. By securing such a low hardness, it is possible to secure high moldability, and as a result, it is possible to smoothly perform part molding, which is a post-process.

Hereinafter, the QT heat treated high carbon cold rolled steel sheet of the present disclosure will be described.

The microstructure of the QT heat treated high carbon cold rolled steel sheet of the present disclosure preferably includes carbide: 0.1 to 20%, and the balance being tempered martensite in area %. In the present disclosure, by including tempered martensite as a base structure, it is possible to secure excellent wear resistance as well as resistance to impact. In addition, the present disclosure increases wear resistance by securing an appropriate fraction of carbides. When the fraction of the carbide is less than 0.1%, there is a disadvantage in that it is difficult to expect wear resistance by hard carbide, and when the fraction exceeds 20%, there is a disadvantage in that the material is easily destroyed due to brittleness. A lower limit of the fraction of the carbide is more preferably 0.2%, and even more preferably 0.5%. An upper limit of the fraction of the carbide is more preferably 18%, and even more preferably 16%. Meanwhile, in the present disclosure, the type of the carbide is not particularly limited, and for example, the carbide may be a single or composite carbide containing one or more of W, V, Mo, and Nb. Meanwhile, the microstructure of the QT heat treated high carbon hot rolled steel sheet of the present disclosure may inevitably include less than 10% of one or more of ferrite, pearlite, bainite, and retained austenite in a total amount due to the manufacturing process. When the total amount of one or more of the ferrite, pearlite, bainite, and retained austenite exceeds 10%, the hardness may decrease. The total amount of one or more of the ferrite, pearlite, bainite and retained austenite is more preferably 7% or less, and even more preferably 5%.

The carbide may have an average size of 0.1 to 20 μm. When the size of the carbide is less than 0.1 μm, the hardness improvement effect is insignificant, and when the size exceeds 20 μm, the brittleness of the steel material may be caused. A lower limit of an average size of the carbide is more preferably 0.3 μm, and even more preferably 0.5 μm. An upper limit of the average size of the carbide is more preferably 17 μm, and even more preferably 15 μm.

The QT heat treated high carbon cold rolled steel sheet according to one embodiment of the present disclosure provided as above may have a hardness of 350 Hv or more. In addition, when the wear resistance test was performed according to the ASTM G99 method, the QT heat treated high carbon cold rolled steel sheet may have a wear reduction of 25 mg or less when the reheating temperature before QT is 900° C. As a result, it is possible to simultaneously secure excellent hardness and wear resistance.

Hereinafter, a method for manufacturing a QT heat treated high carbon hot rolled steel sheet according to an embodiment of the present disclosure will be described.

First, a hot-rolled steel sheet having the above alloy composition is prepared. The step of preparing the hot-rolled steel sheet may include heating a slab at 1100 to 1300° C.; and hot rolling the heated slab at 700 to 1100° C. When the heating temperature of the slab is lower than 1100° C., the ripening degree is low, so rolling may be difficult, and when the hot rolling temperature exceeds 1300° C., there is a disadvantage in that the slab may be melted locally depending on whether high temperature oxidation occurs or temperature deviation occurs in the furnace. When the hot rolling temperature is lower than 700° C., there is a disadvantage in that the hot rolling load may increase due to the high strength of the material, and when the hot rolling temperature exceeds 1100° C., the surface quality may deteriorate due to the high temperature oxidation.

The hot-rolled steel sheet thus prepared may have one or more of microstructures of pearlite, bainite, and martensite in which cementite is partially precipitated at grain boundaries. In addition, the prepared hot-rolled steel sheet may have a hardness of 200 Hv or more.

Thereafter, the hot-rolled steel sheet is reheated at 740 to 1100° C. When the reheating temperature of the hot-rolled steel sheet is lower than 740° C., there is a disadvantage in that austenite may not be obtained and the martensite transformation does not occur after quenching, and when the reheating temperature exceeds 1100° C., crystal grains grow excessively and desired physical properties may not be obtained. A lower limit of the reheating temperature of the hot-rolled steel sheet is more preferably 800° C. An upper limit of the reheating temperature of the hot-rolled steel sheet is more preferably 1050° C.

Thereafter, the reheated hot-rolled steel sheet is cooled at a cooling rate of 10° C./s or higher. When the cooling rate is lower than 10° C., there is a disadvantage in that low hardness microstructures such as ferrite and pearlite may occur during the cooling process after the reheating. The cooling rate is more preferably 40° C. or higher, more preferably 90° C./s or higher, and most preferably 100° C./s or higher. Meanwhile, in the present disclosure, since the faster the cooling rate, the more preferable, the upper limit is not particularly limited. However, it may be difficult to exceed 200° C./s due to design limitations.

Thereafter, the cooled hot-rolled steel sheet is tempered at 150 to 600° C. When the tempering temperature is lower than 150° C., there is a disadvantage in that dislocation recovery is insufficient and there is no tempering effect, and when the tempering temperature exceeds 600° C., there is a disadvantage in that the phase transformation may occur. A lower limit of the tempering temperature is more preferably 170° C., and even more preferably 190° C. An upper limit of the tempering temperature is more preferably 500° C., even more preferably 450° C., and most preferably 380° C.

Hereinafter, a method for manufacturing a high carbon cold rolled steel sheet of the present disclosure will be described.

First, a hot-rolled steel sheet having the above alloy composition is prepared. The step of preparing the hot-rolled steel sheet may include heating a slab at 1100 to 1300° C.; and hot rolling the heated slab at 700 to 1100° C. When the heating temperature of the slab is lower than 1100° C., the ripening degree is low, so rolling may be difficult, and when the hot rolling temperature exceeds 1300° C., there is a disadvantage in that the slab may be melted locally depending on whether high temperature oxidation occurs or temperature deviation occurs in the furnace. When the hot rolling temperature is lower than 700° C., there is a disadvantage in that the hot rolling load may increase due to the high strength of the material, and when the hot rolling temperature exceeds 1100° C., the surface quality may deteriorate due to the high temperature oxidation.

The hot-rolled steel sheet thus prepared may have one or more of microstructures of pearlite, bainite, and martensite in which cementite is partially precipitated at grain boundaries. In addition, the prepared hot-rolled steel sheet may have a hardness of 200 Hv or more.

Meanwhile, a step of performing spheroidization annealing heat treatment on the prepared hot-rolled steel sheet at 630 to 850° C. may be further included. The spheroidization annealing heat treatment is impossible to perform the cold-rolling process due to the high strength of the hot-rolled steel sheet or is intended to inhibit the occurrence of equipment defects. That is, the spheroidization annealing heat treatment is intended to ensure that the cold rolling process is smoothly performed by lowering the strength through spheroidization of cementite having particularly high strength. When the spheroidization annealing heat treatment temperature is lower than 630° C., the time required for the spheroidization may be excessively long, resulting in a decrease in economic efficiency, and when the spheroidization annealing heat treatment exceeds 800° C., pearlite is generated during the heat treatment process, and thus, the strength or hardness reduction effect may be insignificant. A lower limit of the spheroidization annealing heat treatment temperature is more preferably 650° C., and even more preferably 670° C. An upper limit of the spheroidization annealing heat treatment temperature is more preferably 830° C., and even more preferably 810° C.

Thereafter, the hot-rolled steel sheet is cold-rolled to obtain the cold-rolled steel sheet. The cold rolling process may be performed by a method commonly performed in the art. Therefore, in the present disclosure, the cold-rolling process is not particularly limited as long as the cold-rolled steel sheet having a targeted thickness may be obtained.

Meanwhile, the method for manufacturing a high carbon cold rolled steel sheet may include performing the above-described spheroidization annealing heat treatment and cold rolling process once or twice or more.

Hereinafter, a method for manufacturing a QT heat treated high carbon cold rolled steel sheet according to an embodiment of the present disclosure will be described.

First, a hot-rolled steel sheet having the above alloy composition is prepared. The step of preparing the hot-rolled steel sheet may include heating a slab at 1100 to 1300° C.; and hot rolling the heated slab at 700 to 1100° C. When the heating temperature of the slab is lower than 1100° C., the ripening degree is low, so rolling may be difficult, and when the hot rolling temperature exceeds 1300° C., there is a disadvantage in that the slab may be melted locally depending on whether high temperature oxidation occurs or temperature deviation occurs in the furnace. When the hot rolling temperature is lower than 700° C., there is a disadvantage in that the hot rolling load may increase due to the high strength of the material, and when the hot rolling temperature exceeds 1100° C., the surface quality may deteriorate due to the high temperature oxidation.

The hot-rolled steel sheet thus prepared may have one or more of microstructures of pearlite, bainite, and martensite in which cementite is partially precipitated at grain boundaries. In addition, the prepared hot-rolled steel sheet may have a hardness of 200 Hv or more.

Meanwhile, a step of performing spheroidization annealing heat treatment on the prepared hot-rolled steel sheet at 630 to 850° C. may be further included. The spheroidization annealing heat treatment is impossible to perform the cold-rolling process due to the high strength of the hot-rolled steel sheet or is intended to inhibit the occurrence of equipment defects. That is, the spheroidization annealing heat treatment is intended to ensure that the cold rolling process is smoothly performed by lowering the strength through spheroidization of cementite having particularly high strength. When the spheroidization annealing heat treatment temperature is lower than 630° C., the time required for the spheroidization may be excessively long, resulting in a decrease in economic efficiency, and when the spheroidization annealing heat treatment exceeds 800° C., pearlite is generated during the heat treatment process, and thus, the strength or hardness reduction effect may be insignificant. A lower limit of the spheroidization annealing heat treatment temperature is more preferably 650° C., and even more preferably 670° C. An upper limit of the spheroidization annealing heat treatment temperature is more preferably 830° C., and even more preferably 810° C.

Thereafter, the hot-rolled steel sheet is cold-rolled to obtain the cold-rolled steel sheet. The cold rolling process may be performed by a method commonly performed in the art. Therefore, in the present disclosure, the cold-rolling process is not particularly limited as long as the cold-rolled steel sheet having a targeted thickness may be obtained.

Thereafter, the cold-rolled steel sheet is reheated at 740 to 1100° C. When the reheating temperature of the cold-rolled steel sheet is lower than 740° C., there is a disadvantage in that austenite may not be obtained and the martensite transformation does not occur after quenching, and when the reheating temperature exceeds 1100° C., crystal grains grow excessively and desired physical properties may not be obtained. A lower limit of the reheating temperature of the cold-rolled steel sheet is more preferably 800° C. An upper limit of the reheating temperature of the cold-rolled steel sheet is more preferably 1050° C.

Thereafter, the reheated cold-rolled steel sheet is cooled at a cooling rate of 10° C./s or higher. When the cooling rate is lower than 10° C., there is a disadvantage in that low hardness microstructures such as ferrite and pearlite may occur during the cooling process after the reheating. The cooling rate is more preferably 40° C. or higher, more preferably 90° C./s or higher, and most preferably 100° C./s or higher. Meanwhile, in the present disclosure, since the faster the cooling rate, the more preferable, the upper limit is not particularly limited. However, it may be difficult to exceed 200° C./s due to design limitations.

Thereafter, the cooled hot-rolled steel sheet is tempered at 150 to 600° C. When the tempering temperature is lower than 150° C., there is a disadvantage in that dislocation recovery is insufficient and there is no tempering effect, and when the tempering temperature exceeds 600° C., there is a disadvantage in that the phase transformation may occur. A lower limit of the tempering temperature is more preferably 170° C., and even more preferably 190° C. An upper limit of the tempering temperature is more preferably 500° C., even more preferably 450° C., and most preferably 380° C.

MODE FOR INVENTION

Hereinafter, the present disclosure will be described in more detail with reference to Examples. However, the following examples are only examples for describing the present disclosure in more detail, and do not limit the scope of the present disclosure.

Example 1

After heating a slab having alloy compositions of Table 1 at 1200° C., hot rolling was performed at 900° C. to obtain a hot-rolled steel sheet, a hardness of the hot-rolled steel sheet was measured and shown together in Table 1 below. The obtained hot-rolled steel sheet was reheated at 800° C., 850° C., and 900° C., respectively, cooled at a cooling rate of 80° C./s, and then tempered at 200° C. to prepare a QT heat treated hot rolled steel sheet.

After measuring the microstructure, hardness and wear resistance of the QT heat treated hot rolled steel sheet prepared as described above, the results were shown in Table 2 below.

The microstructure fraction was calculated using ThermoCalc software based on thermodynamic properties.

The size of the carbide was observed using a FE-SEM scanning electron microscope. Specifically, after polishing a specimen from #400 to #2000 using sandpaper, final polishing was performed with a 1 μm diamond abrasive, treated with 2% nital etchant, and then observed using an image analysis program.

Hardness was measured using a Vickers hardness tester. In this case, an average value was calculated by repeating the test 5 times with a measuring load of 10 kg.

The wear resistance was evaluated by a ball-on-disk test according to the ASTM G99 method. In this case, a test piece processed in the form of a disk with a diameter of 31 mm and a thickness of 5 mm and a SiC ball with a diameter of 12.7 mm were rubbed at room temperature for 3600 seconds at a force of 50 N and a speed of 1000 rpm, and the test was conducted. The wear resistance was expressed as a value obtained by subtracting a weight after wear from the weight before the wear of the test piece, that is, wear reduction. The smaller the wear reduction, the better the wear resistance.

TABLE 1

| | Alloy Composition (in weight %) | | | | | | | | | | Hardness |
|---|---|---|---|---|---|---|---|---|---|---|---|
| Division | C | Si | Mn | P | S | Cr | W | V | Mo | Nb | (Hv) |
| Conventional Steel (SK120) | 1.2 | 0.25 | 0.3 | 0.008 | 0.001 | 0.45 | — | — | — | — | 324 |

TABLE 1-continued

| Division | Alloy Composition (in weight %) | | | | | | | | | | Hardness |
|---|---|---|---|---|---|---|---|---|---|---|---|
| | C | Si | Mn | P | S | Cr | W | V | Mo | Nb | (Hv) |
| Comparative Steel 1 | 1.2 | 0.25 | 0.3 | 0.008 | 0.001 | 0.45 | 0.02 | — | — | — | 345 |
| Inventive Steel 1 | 1.2 | 0.25 | 0.3 | 0.008 | 0.001 | 0.45 | 0.5 | — | — | — | 352 |
| Inventive Steel 2 | 1.2 | 0.25 | 0.3 | 0.008 | 0.001 | 0.45 | 1.4 | — | — | — | 455 |
| Inventive Steel 3 | 1.2 | 0.25 | 0.3 | 0.008 | 0.001 | 0.45 | 2.3 | — | — | — | 423 |
| Inventive Steel 4 | 1.2 | 0.25 | 0.3 | 0.008 | 0.001 | 10 | 0.5 | — | — | — | 546 |
| Inventive Steel 5 | 1.2 | 0.25 | 0.3 | 0.008 | 0.001 | 0.55 | 0.5 | 0.15 | — | — | 462 |
| Inventive Steel 6 | 1.2 | 0.25 | 0.3 | 0.008 | 0.001 | 0.55 | 0.5 | 0.3 | — | — | 443 |
| Inventive Steel 7 | 1.2 | 0.25 | 0.3 | 0.008 | 0.001 | 0.55 | 0.5 | 0.6 | — | — | 484 |
| Comparative Steel 2 | 1.2 | 0.25 | 0.3 | 0.008 | 0.001 | 0.55 | — | 0.6 | — | — | 487 |
| Inventive Steel 8 | 1.2 | 0.25 | 0.3 | 0.008 | 0.001 | 0.55 | 0.5 | — | 0.5 | — | 432 |
| Inventive Steel 9 | 1.2 | 0.25 | 0.3 | 0.008 | 0.001 | 0.55 | 0.5 | — | 1 | — | 465 |
| Inventive Steel 10 | 1.2 | 0.25 | 0.3 | 0.008 | 0.001 | 0.55 | 0.5 | — | 2 | — | 520 |
| Comparative Steel 3 | 1.2 | 0.25 | 0.3 | 0.008 | 0.001 | 0.55 | — | — | 2 | — | 518 |
| Inventive Steel 11 | 1.2 | 0.25 | 0.3 | 0.008 | 0.001 | 0.55 | 0.5 | — | — | 0.5 | 346 |
| Inventive Steel 12 | 1.2 | 0.25 | 0.3 | 0.008 | 0.001 | 0.55 | 0.5 | — | — | 1 | 354 |
| Inventive Steel 13 | 1.2 | 0.25 | 0.3 | 0.008 | 0.001 | 0.55 | 0.5 | 0.15 | 1.5 | — | 501 |
| Inventive Steel 14 | 1.2 | 0.25 | 0.3 | 0.008 | 0.001 | 0.55 | 0.5 | 0.3 | 1 | — | 495 |
| Comparative Steel 4 | 1.2 | 0.25 | 0.3 | 0.008 | 0.001 | 0.55 | — | 0.5 | 1.2 | — | 508 |
| Inventive Steel 15 | 1.2 | 0.25 | 0.3 | 0.008 | 0.001 | 0.55 | 0.5 | 0.3 | — | 0.5 | 365 |

TABLE 2

| Division | Microstructure of QT heat treated hot rolled steel sheet | | | Hardness (Hv) | | | Wear reduction (mg) | | |
|---|---|---|---|---|---|---|---|---|---|
| | Tempered martensite (area %) | Carbide (area %) | Carbide size (μm) | 800° C. | 850° C. | 900° C. | 800° C. | 850° C. | 900° C. |
| Conventional Steel (SK120) | 100.0 | 0 | — | 387 | 449 | 733 | 38.5 | 31.2 | 26.8 |
| Comparative Steel 1 | 100.0 | 0 | — | 390 | 453 | 760 | 36.2 | 34.1 | 26.5 |
| Inventive Steel 1 | 99.86 | 0.14 | 5 | 478 | 703 | 878 | 33.3 | 26.4 | 21.8 |
| Inventive Steel 2 | 99.4 | 0.6 | 6 | 819 | 902 | 879 | 26.7 | 21.3 | 21.7 |
| Inventive Steel 3 | 98.9 | 1.1 | 8 | 832 | 916 | 968 | 27 | 21.5 | 20.4 |
| Inventive Steel 4 | 85.9 | 14.1 | 5 | 556 | 819 | 823 | 34.8 | 22.9 | 23.1 |
| Inventive Steel 5 | 99.6 | 0.4 | 3 | 503 | 845 | 942 | 32.5 | 24.8 | 23.7 |
| Inventive Steel 6 | 99.3 | 0.7 | 7 | 558 | 859 | 922 | 29.3 | 21.5 | 23.9 |
| Inventive Steel 7 | 98.6 | 1.4 | 10 | 521 | 882 | 949 | 30.1 | 21.9 | 20.5 |
| Comparative Steel 2 | 98.7 | 1.3 | 0.05 | 466 | 720 | 934 | 40 | 30 | 25.7 |

TABLE 2-continued

| Division | Microstructure of QT heat treated hot rolled steel sheet | | | Hardness (Hv) | | | Wear reduction (mg) | | |
|---|---|---|---|---|---|---|---|---|---|
| | Tempered martensite (area %) | Carbide (area %) | Carbide size (μm) | 800° C. | 850° C. | 900° C. | 800° C. | 850° C. | 900° C. |
| Inventive Steel 8 | 99.54 | 0.46 | 0.5 | 958 | 1004 | 949 | 22.6 | 21 | 23.8 |
| Inventive Steel 9 | 98.5 | 1.5 | 6 | 909 | 939 | 892 | 22.8 | 23.2 | 22.6 |
| Inventive Steel 10 | 95.1 | 4.9 | 10 | 983 | 957 | 886 | 25.3 | 26.6 | 22.2 |
| Comparative Steel 3 | 95.3 | 4.7 | 0.03 | 965 | 944 | 857 | 35 | 27.5 | 25.3 |
| Inventive Steel 11 | 99.3 | 0.7 | 8 | 633 | 935 | 948 | 27.3 | 21 | 20.9 |
| Inventive Steel 12 | 98.6 | 1.4 | 10 | 745 | 912 | 916 | 25.4 | 21 | 21.4 |
| Inventive Steel 13 | 97.0 | 3 | 0.5 | 1027 | 1008 | 938 | 19.2 | 21.8 | 24.3 |
| Inventive Steel 14 | 98.4 | 1.6 | 1 | 993 | 995 | 961 | 22.8 | 22.4 | 20.3 |
| Comparative Steel 4 | 97.9 | 2.1 | 0.05 | 1009 | 1986 | 906 | 36.5 | 28 | 25 |
| Inventive Steel 15 | 98.7 | 1.3 | 5 | 777 | 935 | 943 | 25 | 22.2 | 20.1 |

As can be seen from Tables 1 and 2, in the case of Inventive Steels 1 to 15 that satisfy the conditions proposed by the present disclosure, it could be seen that they have excellent hardness and wear resistance as the microstructure and carbide size to be obtained by the present disclosure are secured.

On the other hand, in the case of the conventional steel or comparative steels 1 to 4 that do not satisfy the W content conditions proposed by the present disclosure, it could be seen that the hardness and wear resistance are low as the size of carbide to be obtained by the present disclosure is not secured.

Example 2

The slab having the alloy compositions of Table 1 described in the Example 1 was heated at 1200° C. and then hot-rolled at 900° C. to obtain the hot-rolled steel sheet, and the hot-rolled steel sheet was subjected to spheroidization annealing heat treatment at 770° C. and then cold-rolled to manufacture the cold-rolled steel sheet. In addition, the cold-rolled steel sheet was reheated at 900° C., cooled at a cooling rate of 40° C./s, and then tempered at 210° C. to prepare the QT heat treated cold rolled steel sheet.

After measuring the microstructure and hardness of the cold-rolled steel sheet prepared as described above, the results were shown in Table 3 below. In addition, after measuring the microstructure, hardness and wear resistance of the QT heat treated hot rolled steel sheet prepared as described above, the results were shown in Table 4 below.

The microstructure, hardness and wear resistance were measured using the same method as in Example 1.

TABLE 3

| Division | Cold rolled steel sheet microstructure | | | | Hardness (Hv) |
|---|---|---|---|---|---|
| | Ferrite (area %) | Cementite (area %) | Carbide (area %) | Carbide size (μm) | |
| Conventional steel (SK120) | 94.11 | 5.9 | 0 | — | 230 |
| Comparative Steel 1 | 94.09 | 5.9 | 0 | — | 238 |
| Inventive Steel 1 | 94.33 | 5.7 | 0.14 | 5 | 243 |
| Inventive Steel 2 | 95.1 | 4.9 | 0.6 | 6 | 251 |
| Inventive Steel 3 | 95.9 | 4.1 | 1.1 | 8 | 254 |
| Inventive Steel 4 | 100 | 0.0 | 14.1 | 5 | 281 |
| Inventive Steel 5 | 94.32 | 5.7 | 0.4 | 3 | 247 |
| Inventive Steel 6 | 95 | 5.0 | 0.7 | 7 | 252 |
| Inventive Steel 7 | 96.27 | 3.7 | 1.4 | 10 | 253 |
| Comparative Steel 2 | 96.1 | 3.9 | 1.3 | 0.05 | 243 |
| Inventive Steel 8 | 94.5 | 5.5 | 0.46 | 0.5 | 253 |
| Inventive Steel 9 | 95.5 | 4.5 | 1.5 | 6 | 258 |
| Inventive Steel 10 | 97.9 | 2.1 | 4.9 | 10 | 261 |
| Comparative Steel 3 | 97.6 | 2.4 | 4.7 | 0.03 | 260 |
| Inventive Steel 11 | 95.2 | 4.8 | 0.7 | 8 | 246 |
| Inventive Steel 12 | 96.4 | 3.6 | 1.4 | 10 | 249 |
| Inventive Steel 13 | 96.9 | 3.1 | 3 | 0.5 | 257 |
| Inventive Steel 14 | 96.3 | 3.7 | 1.6 | 1 | 251 |
| Comparative Steel 4 | 97 | 3.0 | 2.1 | 0.05 | 290 |

TABLE 3-continued

| Division | Cold rolled steel sheet microstructure | | | | Hardness (Hv) |
|---|---|---|---|---|---|
| | Ferrite (area %) | Cementite (area %) | Carbide (area %) | Carbide size (μm) | |
| Inventive Steel 15 | 96.2 | 3.8 | 1.3 | 5 | 248 |

TABLE 4

| Division | Microstructure of QT heat treated cold rolled steel sheet | | | Hardness (Hv) | Wear reduction (mg) |
|---|---|---|---|---|---|
| | Tempered martensite (area %) | Carbide (area %) | Carbide size (μm) | | |
| Conventional steel (SK120) | 100.0 | 0 | — | 733 | 26.8 |
| Comparative Steel 1 | 100.0 | 0 | — | 760 | 26.5 |
| Inventive Steel 1 | 99.86 | 0.14 | 5 | 878 | 21.8 |
| Inventive Steel 2 | 99.4 | 0.6 | 6 | 879 | 21.7 |
| Inventive Steel 3 | 98.9 | 1.1 | 8 | 968 | 20.4 |
| Inventive Steel 4 | 85.9 | 14.1 | 5 | 823 | 23.1 |
| Inventive Steel 5 | 99.6 | 0.4 | 3 | 942 | 23.7 |
| Inventive Steel 6 | 99.3 | 0.7 | 7 | 922 | 23.9 |
| Inventive Steel 7 | 98.6 | 1.4 | 10 | 949 | 20.5 |
| Comparative Steel 2 | 98.7 | 1.3 | 0.05 | 934 | 25.7 |
| Inventive Steel 8 | 99.54 | 0.46 | 0.5 | 949 | 23.8 |
| Inventive Steel 9 | 98.5 | 1.5 | 6 | 892 | 22.6 |
| Inventive Steel 10 | 95.1 | 4.9 | 10 | 886 | 22.2 |
| Comparative Steel 3 | 95.3 | 4.7 | 0.03 | 857 | 25.3 |
| Inventive Steel 11 | 99.3 | 0.7 | 8 | 948 | 20.9 |
| Inventive Steel 12 | 98.6 | 1.4 | 10 | 916 | 21.4 |
| Inventive Steel 13 | 97.0 | 3 | 0.5 | 938 | 24.3 |
| Inventive Steel 14 | 98.4 | 1.6 | 1 | 961 | 20.3 |
| Comparative Steel 4 | 97.9 | 2.1 | 0.05 | 906 | 25 |
| Inventive Steel 15 | 98.7 | 1.3 | 5 | 943 | 20.1 |

As can be seen from Tables 3 and 4, in the case of Inventive Steels 1 to 15 that satisfy the conditions proposed by the present disclosure, it could be seen that they have excellent hardness and wear resistance as the microstructure and carbide size to be obtained by the present disclosure are secured.

On the other hand, in the case of the conventional steel or comparative steels 1 to 4 that do not satisfy the W content conditions proposed by the present disclosure, it could be seen that the hardness and wear resistance are low as the size of carbide to be obtained by the present disclosure is not secured.

The invention claimed is:

1. A QT heat treated high carbon hot rolled steel sheet, comprising:

in weight %, C: 1.0 to 1.4%, Si: 0.1 to 0.4%, Mn: 0.1 to 0.8%, Cr: 0.3 to 11%, W: 0.05 to 2.5%, P: 0.03% or less, S: 0.03% or less, Al: 0.02% or less, and a balance of Fe and other inevitable impurities, wherein a microstructure contains, in area %, carbide: 0.1 to 20% and the balance being tempered martensite, an average size of the carbide is 0.1 to 20 μm, and wherein the hot-rolled steel sheet has a wear reduction of 35 mg or less when a reheating temperature before OT is 800° C., a wear reduction of 27 mg or less when the reheating temperature before QT is 850° C., and a wear reduction of 25 mg or less when the reheating temperature before QT is 900° C.

2. The QT heat treated high carbon hot rolled steel sheet of claim 1, wherein the hot-rolled steel sheet further includes one or more selected from the group consisting of V: 0.8% or less (excluding 0%), Mo: 2.5% or less (excluding 0%), and Nb: 1.5% or less (excluding 0%).

3. The QT heat treated high carbon hot rolled steel sheet of claim 1, wherein the hot-rolled steel sheet has a hardness of 350 Hv or more.

4. A QT heat treated high carbon cold rolled steel sheet, comprising:

in weight %, C: 1.0 to 1.4%, Si: 0.1 to 0.4%, Mn: 0.1 to 0.8%, Cr: 0.3 to 11%, W: 0.05 to 2.5%, P: 0.03% or less, S: 0.03% or less, Al: 0.02% or less, and a balance of Fe and other inevitable impurities, wherein a microstructure contains, in area %, carbide: 0.1 to 20% and the balance being tempered martensite, an average size of the carbide is 0.1 to 20 μm, and wherein the cold-rolled steel sheet has a wear reduction of 25 mg or less when the reheating temperature before QT is 900° C.

5. The QT heat treated high carbon cold rolled steel sheet of claim 4, wherein the cold-rolled steel sheet further includes one or more selected from the group consisting of V: 0.8% or less (excluding 0%), Mo: 2.5% or less (excluding 0%), and Nb: 1.5% or less (excluding 0%).

6. The QT heat treated high carbon cold rolled steel sheet of claim 4, wherein the cold-rolled steel sheet has a hardness of 350 Hv or more.

* * * * *